US008371829B2

(12) United States Patent
Jaeb et al.

(10) Patent No.: US 8,371,829 B2
(45) Date of Patent: Feb. 12, 2013

(54) FLUID DISC PUMP WITH SQUARE-WAVE DRIVER

(75) Inventors: Jonathan Jaeb, Boerne, TX (US); Christopher John Padbury, Melbourn (GB)

(73) Assignee: KCI Licensing, Inc., San Antonio, TX (US)

( * ) Notice: Subject to any disclaimer, the term of this patent is extended or adjusted under 35 U.S.C. 154(b) by 413 days.

(21) Appl. No.: 12/699,665

(22) Filed: Feb. 3, 2010

(65) Prior Publication Data

US 2011/0190670 A1 Aug. 4, 2011

(51) Int. Cl.
*F04B 17/04* (2006.01)
*F04B 19/24* (2006.01)

(52) U.S. Cl. ..... 417/413.2; 417/53

(58) Field of Classification Search .. 601/6; 417/52–53, 417/413.2

See application file for complete search history.

(56) References Cited

U.S. PATENT DOCUMENTS

| | | | | |
|---|---|---|---|---|
| 5,614,770 | A * | 3/1997 | Suelzle | 307/105 |
| 2001/0035700 | A1 | 11/2001 | Percin et al. | |
| 2004/0000843 | A1 * | 1/2004 | East | 310/331 |
| 2005/0285686 | A1 * | 12/2005 | Pettersen et al. | 331/16 |
| 2007/0035213 | A1 | 2/2007 | Nakajima | |

FOREIGN PATENT DOCUMENTS

| | | | |
|---|---|---|---|
| DE | 44 22 743 | A1 | 1/1996 |
| JP | 2009-156454 | A | 7/2009 |
| WO | WO 94/19609 | A | 9/1994 |
| WO | WO 2004/090335 | A1 | 10/2004 |
| WO | WO 2006/111775 | A | 10/2006 |
| WO | WO 2009/072261 | A1 | 6/2009 |
| WO | WO 2009/087714 | A1 | 7/2009 |
| WO | WO 2009/112866 | A1 | 9/2009 |

OTHER PUBLICATIONS

International Search Report and Written Opinion date mailed Dec. 10, 2009; PCT International Application No. PCT/GB2009/050615.

* cited by examiner

*Primary Examiner* — Quynh-Nhu H Vu

(57) ABSTRACT

A pump having a substantially cylindrical shape and defining a cavity formed by a side wall closed at both ends by end walls wherein the cavity contains a fluid is disclosed. The pump further comprises an actuator operatively associated with at least one of the end walls to cause an oscillatory motion of the driven end wall to generate displacement oscillations of the driven end wall within the cavity. The pump further comprises a valve for controlling the flow of fluid through the valve.

14 Claims, 11 Drawing Sheets

300
90
45
0
-45
-90
kHz
10000
1000
100
10
0
50
100
150
200
250
302
304
311
312
313
314
315

370 (50%)
380 (43%)
An
1.6
1.4
1.2
1.0
0.8
0.6
0.4
0.2
n
371
372
373
374
375
376
377
378
379
381
382
383
384
385
387
388
389

FLUID DISC PUMP WITH SQUARE-WAVE DRIVER

BACKGROUND OF THE INVENTION

1. Field of the Invention

The illustrative embodiments of the invention relate generally to a pump for pumping fluid and, more specifically, to a pump having a substantially disc-shaped cavity with substantially circular end walls and a side wall and a valve for controlling the flow of fluid through the pump in conjunction with an electronic circuit for driving a square-wave signal that reduces harmonic excitation of the pump.

2. Description of Related Art

The generation of high amplitude pressure oscillations in closed cavities has received significant attention in the fields of thermo-acoustics and pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, bulb have been used to achieve high amplitude pressure oscillations thereby significantly increasing the pumping effect. In such high amplitude waves the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775 (the '487 Application) discloses a pump having a substantially disc-shaped cavity with a high aspect ratio, i.e., the ratio of the radius of the cavity to the height of the cavity.

Such a pump has a substantially cylindrical cavity comprising a side wall closed at each end by end walls. The pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the pump is mode-matched, work done by the actuator on the fluid in the cavity adds constructively across the driven end wall surface, thereby enhancing the amplitude of the pressure oscillation in the cavity and delivering high pump efficiency. The efficiency of a mode-matched pump is dependent upon the interface between the driven end wall and the side wall. It is desirable to maintain the efficiency of such pump by structuring the interface so that it does not decrease or dampen the motion of the driven end wall thereby mitigating any reduction in the amplitude of the fluid pressure oscillations within the cavity.

The actuator of the pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in the '487 Application which is incorporated by reference herein, such oscillations referred to hereinafter as "radial oscillations" of the fluid pressure within the cavity. A portion of the driven end wall between the actuator and the side wall provides an interface with the side wall of the pump that decreases dampening of the displacement oscillations to mitigate any reduction of the pressure oscillations within the cavity, that portion being referred to hereinafter as an "isolator." The illustrative embodiments of the isolator are operatively associated with the peripheral portion of the driven end wall to reduce dampening of the displacement oscillations.

More specifically, the pump comprises a pump body having a substantially cylindrical shape defining a cavity formed by a side wall closed at both ends by substantially circular end walls, at least one of the end walls being a driven end wall having a central portion and a peripheral portion adjacent the side wall, wherein the cavity contains a fluid when in use. The pump further comprises an actuator operatively associated with the central portion of the driven end wall to cause an oscillatory motion of the driven end wall in a direction substantially perpendicular thereto with a maximum amplitude at about the centre of the driven end wall, thereby generating displacement oscillations of the driven end wall when in use. The pump further comprises an isolator operatively associated with the peripheral portion of the driven end wall to reduce dampening of the displacement oscillations caused by the end wall's connection to the side wall of the cavity as described more specifically in U.S. patent application Ser. No. 12/477,594 which is incorporated by reference herein. The pump further comprises a first aperture disposed at about the centre of one of the end walls, and a second aperture disposed at any other location in the pump body, whereby the displacement oscillations generate radial oscillations of fluid pressure within the cavity of said pump body causing fluid flow through said apertures.

Such pumps also require one or more valves for controlling the flow of fluid through the pump and, more specifically, valves being capable of operating at high frequencies. Conventional valves typically operate at lower frequencies below 500 Hz for a variety of applications. For example, many conventional compressors typically operate at 50 or 60 Hz. Linear resonance compressors known in the art operate between 150 and 350 Hz. However, many portable electronic devices including medical devices require pumps for delivering a positive pressure or providing a vacuum that are relatively small in size and it is advantageous for such pumps to be inaudible in operation so as to provide discrete operation. To achieve these objectives, such pumps must operate at very high frequencies requiring valves capable of operating at about 20 kHz and higher. To operate at these high frequencies, the valve must be responsive to a high frequency oscillating pressure that can be rectified to create a net flow of fluid through the pump.

Such a valve is described more specifically in International Patent Application No. PCT/GB2009/050614 which is incorporated by reference herein. Valves may be disposed in either the first or second aperture, or both apertures, for controlling the flow of fluid through the pump. Each valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

The actuator may be a piezoelectric actuator that resonates at multiple frequencies in addition to its fundamental frequency, the frequency at which the actuator is intended to be driven. Piezoelectric drive circuits typically employ square-wave drive signals for such actuators because the drive circuit electronics may be lower cost and more compact. These factors are important, for example, in medical devices that may be used to generate a reduced pressure for treating wounds, and in other applications where a compact pump and drive electronics are required. A problem encountered when utilizing a square-wave as the drive signal for such actuators is that a square wave contains additional frequencies at multiples of its fundamental frequency (f), i.e., harmonic frequencies, that can coincide with, or be sufficiently close to, higher-frequency resonant frequencies of the actuator associated with other oscillatory modes (e.g. higher order "bending" modes or radial "breathing" modes of the actuator) that are excited along with the actuator's fundamental mode. Excitation of these modes may substantially reduce the performance of the actuator and, consequently, the pump. For example, excitation of such higher frequency modes may lead to increased power consumption resulting in reduced pump efficiency.

SUMMARY

According to the principles of the present invention, the pump further comprises a drive circuit having an output that drives the piezoelectric component of the actuator primarily at the fundamental frequency. The drive signal is a square-wave signal and the drive circuit eliminates or attenuates certain harmonic frequencies of the square-wave signal that would otherwise excite higher frequency resonant modes of the actuator and thereby reduce pump efficiency. The drive circuit may include a low-pass filter or a notch filter to suppress undesired harmonic signals in the square-wave. Alternatively, the processing circuitry may modify the duty cycle of the square-wave signal to achieve the same effect.

Other objects, features, and advantages of the illustrative embodiments are described herein and will become apparent with reference to the drawings and detailed description that follow.

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1A:
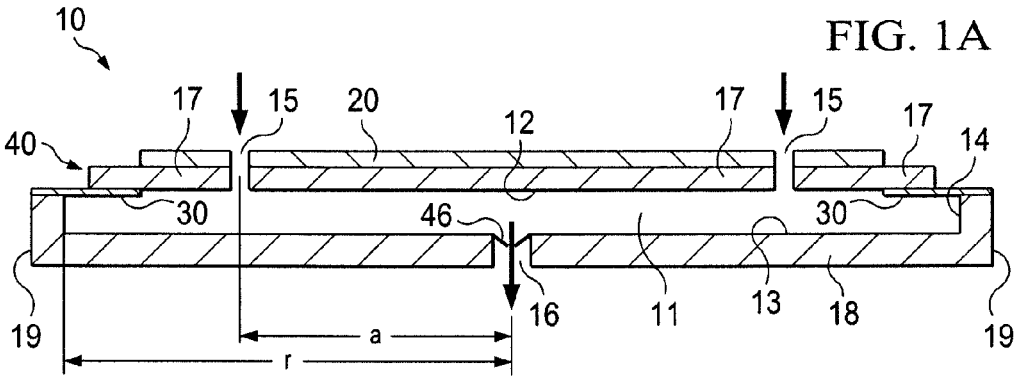
FIG. 1A shows a schematic cross-section view of a first pump according to an illustrative embodiment of the invention.
Figure 1B:
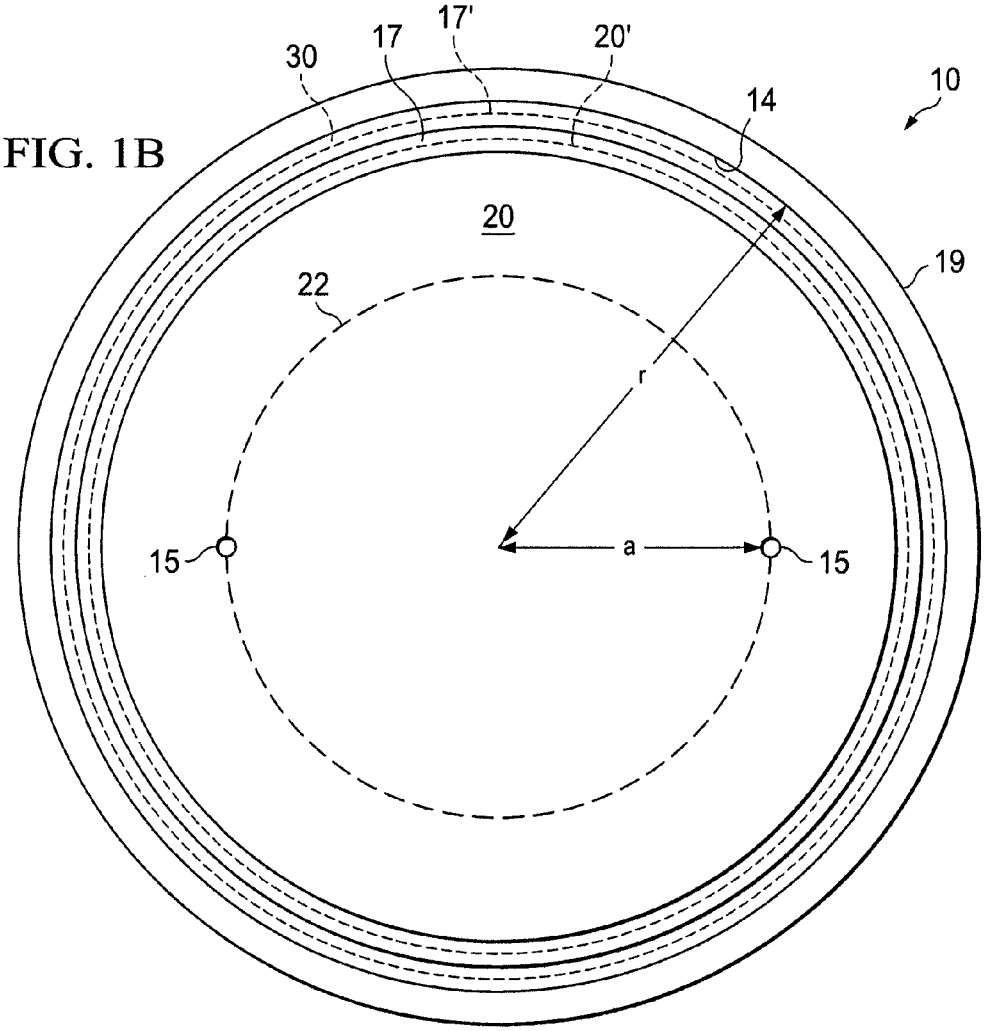
FIG. 1B shows a schematic top view of the first pump of FIG. 1A.

FIG. 1A is a schematic cross-section view of a pump 10 according to an illustrative embodiment of the invention. Referring also to FIG. 1B, pump 10 comprises a pump body having a substantially cylindrical shape including a cylindrical wall 19 closed at one end by a base 18 and closed at the other end by a end plate 17 and a ring-shaped isolator 30 disposed between the end plate 17 and the other end of the cylindrical wall 19 of the pump body. The cylindrical wall 19 and base 18 may be a single component comprising the pump body and may be mounted to other components or systems. The internal surfaces of the cylindrical wall 19, the base 18, the end plate 17, and the ring-shaped isolator 30 form a cavity 11 within the pump 10 wherein the cavity 11 comprises a side wall 14 closed at both ends by end walls 12 and 13. The end wall 13 is the internal surface of the base 18 and the side wall 14 is the inside surface of the cylindrical wall 19. The end wall 12 comprises a central portion corresponding to the inside surface of the end plate 17 and a peripheral portion corresponding to the inside surface of the ring-shaped isolator 30. Although the cavity 11 is substantially circular in shape, the cavity 11 may also be elliptical or other shape. The base 18 and cylindrical wall 19 of the pump body may be formed from any suitable rigid material including, without limitation, metal, ceramic, glass, or plastic including, without limitation, inject-molded plastic.

The pump 10 also comprises a piezoelectric disc 20 operatively connected to the end plate 17 to form an actuator 40 that is operatively associated with the central portion of the end wall 12 via the end plate 17. The piezoelectric disc 20 is not required to be formed of a piezoelectric material, but may be formed of any electrically active material that vibrates, such as, for example, an electrostrictive or magnetostrictive material. The end plate 17 preferably possesses a bending stiffness similar to the piezoelectric disc 20 and may be formed of an electrically inactive material, such as a metal or ceramic. When the piezoelectric disc 20 is excited by an electrical current, the actuator 40 expands and contracts in a radial direction relative to the longitudinal axis of the cavity 11 causing the end plate 17 to bend, thereby inducing an axial deflection of the end wall 12 in a direction substantially perpendicular to the end wall 12. The end plate 17 alternatively may also be formed from an electrically active material, such as, for example, a piezoelectric, magnetostrictive, or electrostrictive material. In another embodiment, the piezoelectric disc 20 may be replaced by a device in a force-transmitting relation with the end wall 12, such as, for example, a mechanical, magnetic or electrostatic device, wherein the end wall 12 may be formed as an electrically inactive or passive layer of material driven into oscillation by such device (not shown) in the same manner as described above.

The pump 10 further comprises at least two apertures extending from the cavity 11 to the outside of the pump 10, wherein at least a first one of the apertures may contain a valve to control the flow of fluid through the aperture. Although the aperture containing a valve may be located at any position in the cavity 11 where the actuator 40 generates a pressure differential as described below in more detail, one preferred embodiment of the pump 10 comprises an aperture with a valve located at approximately the centre of either of the end walls 12, 13. The pump 10 shown in FIGS. 1A and 1B comprises a primary aperture 16 extending from the cavity 11 through the base 18 of the pump body at about the centre of the end wall 13 and containing a valve 46. The valve 46 is mounted within the primary aperture 16 and permits the flow of fluid in one direction as indicated by the arrow so that it functions as an outlet for the pump 10. A second aperture 15 may be located at any position within the cavity 11 other than the location of the primary aperture 16 with a valve 46. In one preferred embodiment of the pump 10, the second aperture 15 is disposed between the centre of either one of the end walls 12, 13 and the side wall 14. The embodiment of the pump 10 shown in FIGS. 1A and 1B comprises two secondary apertures 15 extending from the cavity 11 through the actuator 40 that are disposed between the centre of the end wall 12 and the side wall 14. Although the secondary apertures 15 are not valved in this embodiment of the pump 10, they may also be valved to improve performance if necessary. In this embodiment of the pump 10, the primary aperture 16 is valved so that the fluid is drawn into the cavity 11 of the pump 10 through the secondary apertures 15 and pumped out of the cavity 11 through the primary aperture 16 as indicated by the arrows to provide a positive pressure at the primary aperture 16.

Figure 2A:
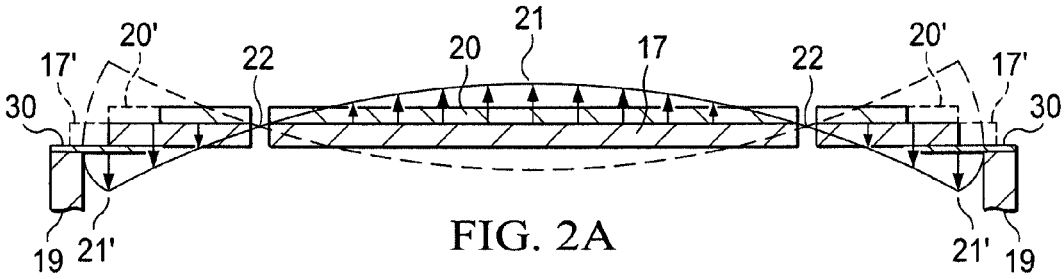
FIG. 2A shows a graph of the axial displacement oscillations for the fundamental bending mode of an actuator of the first pump of FIG. 1A.

FIG. 2A shows one possible displacement profile illustrating the axial oscillation of the driven end wall 12 of the cavity 11. The solid curved line and arrows represent the displacement of the driven end wall 12 at one point in time, and the dashed curved line represents the displacement of the driven end wall 12 one half-cycle later. The displacement as shown in this figure and the other figures is exaggerated. Because the actuator 40 is not rigidly mounted at its perimeter, but rather suspended by the ring-shaped isolator 30, the actuator 40 is free to oscillate about its centre of mass in its fundamental mode. In this fundamental mode, the amplitude of the displacement oscillations of the actuator 40 is substantially zero at an annular displacement node 22 located between the centre of the end wall 12 and the side wall 14. The amplitudes of the displacement oscillations at other points on the end wall 12 have an amplitudes greater than zero as represented by the vertical arrows. A central displacement anti-node 21 exists near the centre of the actuator 40 and a peripheral displacement anti-node 21' exists near the perimeter of the actuator 40.

Figure 2B:
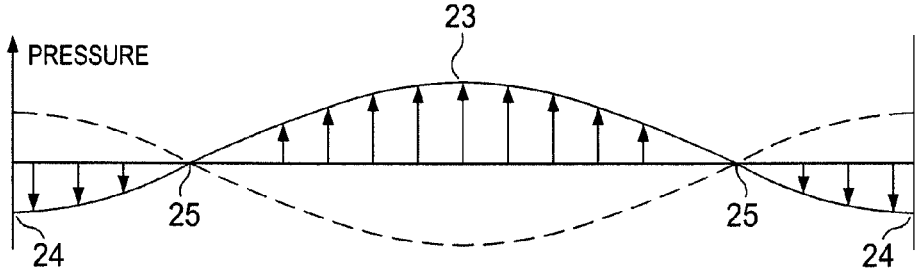
FIG. 2B shows a graph of the pressure oscillations of fluid within the cavity of the first pump of FIG. 1A in response to the bending mode shown in FIG. 2A.

FIG. 2B shows one possible pressure oscillation profile illustrating the pressure oscillation within the cavity 11 resulting from the axial displacement oscillations shown in FIG. 2A. The solid curved line and arrows represent the pressure at one point in time, and the dashed curved line represents the pressure one half-cycle later. In this mode and higher-order modes, the amplitude of the pressure oscillations has a central pressure anti-node 23 near the centre of the cavity 11 and a peripheral pressure anti-node 24 near the side wall 14 of the cavity 11. The amplitude of the pressure oscillations is substantially zero at the annular pressure node 25 between the central pressure anti-node 23 and the peripheral pressure anti-node 24. For a cylindrical cavity, the radial dependence of the amplitude of the pressure oscillations in the cavity 11 may be approximated by a Bessel function of the first kind. The pressure oscillations described above result from the radial movement of the fluid in the cavity 11, and so will be referred to as the "radial pressure oscillations" of the fluid within the cavity 11 as distinguished from the axial displacement oscillations of the actuator 40.

With further reference to FIGS. 2A and 2B, it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in the cavity 11 (the "mode-shape" of the pressure oscillation). By not rigidly mounting the actuator 40 at its perimeter and allowing it to vibrate more freely about its centre of mass, the mode-shape of the displacement oscillations substantially matches the mode-shape of the pressure oscillations in the cavity 11, thus achieving mode-shape matching or, more simply, mode-matching. Although the mode-matching may not always be perfect in this respect, the axial displacement oscillations of the actuator 40 and the corresponding pressure oscillations in the cavity 11 have substantially the same relative phase across the full surface of the actuator 40 wherein the radial position of the annular pressure node 25 of the pressure oscillations in the cavity 11 and the radial position of the annular displacement node 22 of the axial displacement oscillations of actuator 40 are substantially coincident.

Figure 2C:
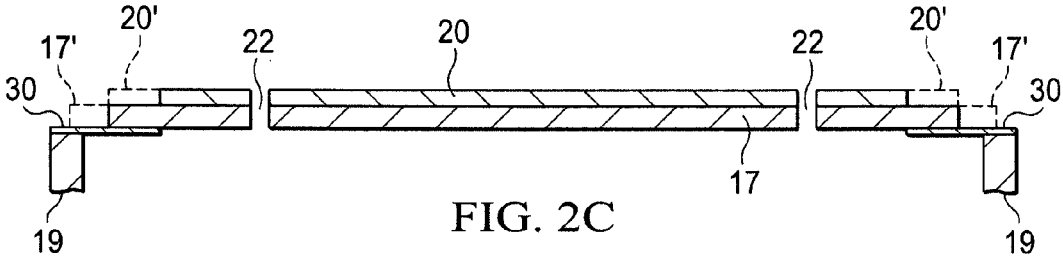
FIG. 2C illustrates one possible radial displacement oscillation (or "breathing mode") for an actuator of the first pump of FIG. 1A.

The mode-shape of the actuator 40 as shown in FIG. 2A is the lowest frequency resonant "bending" mode of the actuator 40 (the "fundamental bending mode"). The arrows illustrate the axial displacement of the actuator 40 which moves between the solid and dashed lines. Antinodes of displacement, central displacement anti-node 21 and peripheral displacement anti-node 21', are located at the centre and edge of the actuator 40, respectively. It will be understood by a person skilled in the art that higher order bending modes exist at higher frequencies. In operation the piezoelectric disc 20 expands and contracts in-plane, i.e., in a direction parallel to the plane of the piezoelectric disc 20. In addition to causing the bending motion described above, this motion also causes the end plate 17 to expand and contract in-plane as represented by the expanded piezoelectric disc 20' and the expanded end plate 17' shown in FIG. 2C. The corresponding in-plane expansion and contraction of the actuator 40 forms a mode of vibration of the actuator 40 known as a "breathing" mode of the actuator 40 (as opposed to an axial displacement or bending mode). Typically the lowest order breathing mode (the "fundamental breathing mode") has a resonant frequency which is significantly higher than the frequency of the fundamental bending mode. It will be understood by a person skilled in the art that higher order breathing modes exist at higher frequencies. Unlike the fundamental bending mode of the actuator 40, such breathing modes of the actuator 40 do not generate useful pressure oscillations in the cavity 11 of the pump 10 as are shown in FIG. 2B for the fundamental bending mode.

As the actuator 40 vibrates about its centre of mass, the radial position of the annular displacement node 22 will necessarily lie inside the radius of the actuator 40 when the actuator 40 vibrates in its fundamental bending mode as illustrated in FIG. 2A. Thus, to ensure that the annular displacement node 22 is coincident with the annular pressure node 25, the radius of the actuator ($r_{act}$) should preferably be greater than the radius of the annular pressure node 25 to optimize mode-matching. Assuming again that the pressure oscillation in the cavity 11 approximates a Bessel function of the first kind, the radius of the annular pressure node 25 would be approximately 0.63 of the radius from the centre of the end wall 13 to the side wall 14, i.e., the radius of the cavity 11 (r) as shown in FIG. 1A. Therefore, the radius of the actuator 40 ($r_{act}$) should preferably satisfy the following inequality: $r_{act} \geqq 0.63r$.

The ring-shaped isolator 30 may be a flexible membrane which enables the edge of the actuator 40 to move more freely as described above by bending and stretching in response to the vibration of the actuator 40 as shown by the displacement at the peripheral displacement anti-node 21' in FIG. 2A. The flexible membrane overcomes the potential dampening effects of the side wall 14 on the actuator 40 by providing a low mechanical impedance support between the actuator 40 and the cylindrical wall 19 of the pump 10 thereby reducing the dampening of the axial oscillations at the peripheral displacement anti-node 21' of the actuator 40. Essentially, the flexible membrane minimizes the energy being transferred from the actuator 40 to the side wall 14, which remains substantially stationary. Consequently, the annular displacement node 22 will remain substantially aligned with the annular pressure node 25 so as to maintain the mode-matching condition of the pump 10. Thus, the axial displacement oscillations of the driven end wall 12 continue to efficiently generate oscillations of the pressure within the cavity 11 from the central pressure anti-node 23 to the peripheral pressure anti-node 24 at the side wall 14 as shown in FIG. 2B.

Figures 3A, 3B:
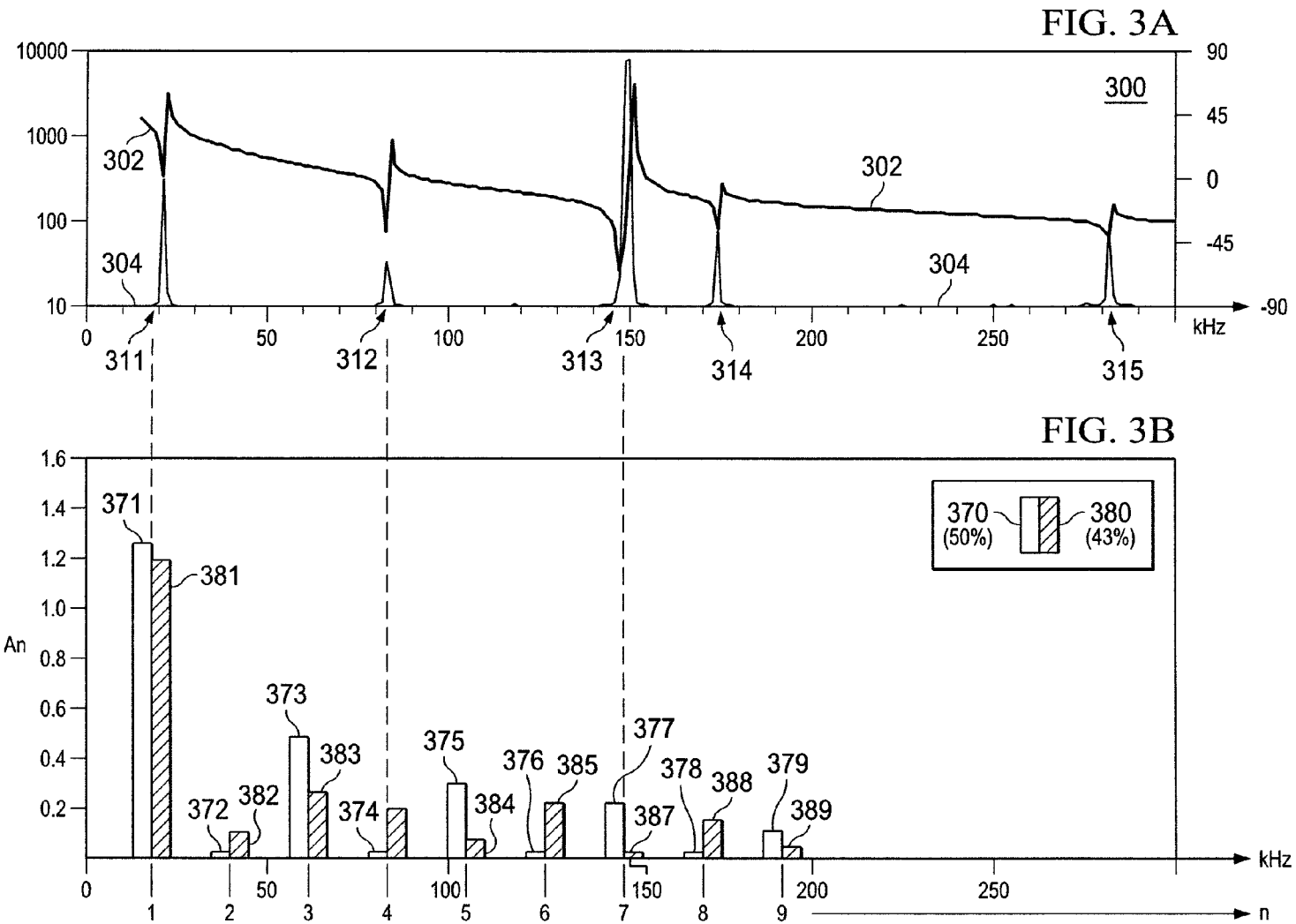
FIG. 3A is a graph of the impedance spectrum showing the resonant modes of the actuator of the pump in FIGS. 1A and 1B.
FIG. 3B is a graph of Fourier components of two square waves (having duty cycles of 50% and 43% respectively) showing the harmonic content of these drive signals as a function of frequency.

Referring to FIG. 3A, a graph of the impedance spectrum 300 of an illustrative actuator 40 is shown including both the magnitude component 302 and the phase component 304 of the impedance as a function of frequency. The impedance spectrum 300 of the actuator 40 has peaks corresponding to the electro-mechanical resonant modes of the actuator 40 at specific frequencies including a fundamental mode 311 of resonance at about 21 kHz and higher frequency modes of resonance. Such higher frequency resonance modes include a second mode 312 of resonance at about 83 kHz, a third mode 313 of resonance at about 147 kHz, a fourth mode 314 of resonance at about 174 kHz, and a fifth mode 315 of resonance at about 282 kHz.

The fundamental mode 311 of resonance at about 21 KHz is the fundamental bending mode that creates the pressure oscillations in the cavity 11 to drive the pump 10 as described above in conjunction with FIGS. 2A and 2B. The second mode 312 of resonance at 83 kHz is a second bending mode that has a second annular displacement node (not shown) in addition to the annular displacement node 22 of the fundamental mode 311. The fourth and fifth modes 314 and 315 of resonance at about 174 kHz and 282 kHz, respectively, are also higher order bending modes that are axially symmetric, having two and three additional annular displacement nodes (not shown), respectively, over and above the annular displacement node 22 of the fundamental mode 311. As can be seen from FIG. 3A, the strength of these bending modes generally decreases with increasing frequency.

The third mode 313 of resonance of the actuator 40 is the fundamental breathing mode (FIG. 2C) that causes the radial displacement of the actuator 40 as described above without generating useful pressure oscillations within the cavity 11 of the pump 10. Essentially, the resonant in-plane motion of the actuator 40 dominates at this frequency, resulting in a very low impedance as can be seen in FIG. 3A. The low impedance of this fundamental breathing mode means that it draws high power when excited by a drive signal at that frequency.

A pulse-width modulated (PWM) square-wave signal comprising a fundamental frequency and harmonic frequencies of the fundamental frequency may be used to drive the actuator 40 described above. Referring to FIG. 3B, a bar graph of the Fourier components (n) representing the harmonics of the PWM square-wave signal indicated by the legend are shown for driving the actuator 40 where "n" is the harmonic number. The Fourier component for each harmonic is listed in Table I with a separate reference number for each of the harmonic components of a PWM square-wave signal having different duty cycles. The PWM square-wave signal 370 has a duty cycle ("DC") of 50%. By duty cycle we mean the percentage of a square-wave period that the signal is in one of its two states, e.g., a signal that is positive for 50% of the period of the square wave has a duty cycle of 50%. The amplitude of each odd harmonic component of a PWM square-wave signal with a 50% duty cycle decreases inversely proportional to the harmonic number. The amplitude of each even harmonic of a PWM square-wave signal with a 50% duty cycle is zero.

TABLE I

Harmonic Frequencies of PWM Drive Signal

| Harmonic (n) | kHz | DC = 50% 370 | DC = 43% 380 |
|---|---|---|---|
| Fundamental Frequency (1) | 20.9 | 371 | 381 |
| Second (2) | 41.8 | 372 | 382 |
| Third (3) | 62.7 | 373 | 383 |
| Fourth (4) | 83.6 | 374 | 384 |
| Fifth (5) | 104.5 | 375 | 385 |
| Sixth (6) | 125.4 | 376 | 386 |
| Seventh (7) | 146.3 | 377 | 387 |
| Eighth (8) | 167.2 | 378 | 388 |
| Ninth (9) | 188.1 | 379 | 389 |

In the example described above, the drive circuit is designed to drive the actuator in its fundamental bending mode, i.e. the frequency of the driving PWM square-wave signal is selected to match the frequency of the fundamental bending mode. However, as can be seen when comparing FIGS. 3A and 3B, certain harmonics of the PWM square-wave signals 370 and 380 may coincide with certain higher-order modes of resonance of the actuator 40. Where a harmonic of the drive signal coincides with a higher-order mode of the actuator, there is the potential for energy to be transferred into this mode, reducing the efficiency of the pump. It should be noted that the level of energy transferred into such a higher-order mode of resonance of the actuator 40 is dependent not only on the strength and type of that relevant mode and its corresponding impedance, but also the amplitude of the drive signal exciting the actuator 40 at that particular harmonic frequency of the fundamental drive frequency. When the mode of resonance is both strong with a low impedance and driven by a significant drive signal amplitude, significant energy may be transferred into and dissipated by vibration of the actuator 40 in these undesirable higher-order modes resulting in reduced pump efficiency. As such, the higher modes of resonance do not contribute to the useful operation of the pump 10, but rather waste the energy and adversely affect the efficiency of the pump 10.

More specifically, in the example of FIG. 3A, the seventh harmonic 377 of the 50% duty-cycle PWM square-wave signal 370 coincides with the low-impedance of the third mode 313 at about 147 kHz. Even though the amplitude of the seventh harmonic 377 has decreased inversely proportional to its harmonic number to a relatively small number, the impedance of the actuator 40 is so low at that frequency that even the relatively small amplitude of the seventh harmonic 377 is sufficient for significant energy to be drawn into the third mode 313. FIG. 4B shows that the power absorbed by the actuator 40 at this frequency is close to that absorbed at the fundamental bending mode frequency: a large fraction of the total input power is thereby wasted, dramatically reducing the efficiency of the pump in operation.

This detrimental excitation of the higher order modes of resonance of the actuator 40 may be suppressed by a number of methods including either reducing the strength of the mode of resonance or reducing the amplitude of the harmonic of the drive signal which is closest in frequency to a particular mode of resonance of the actuator 40. An embodiment of the present invention is directed to an apparatus and method for reducing the excitation of the higher modes of resonance by the harmonics of the drive signal by properly selecting and/or modifying the driving signal. For example, a sine wave drive signal avoids the problem because it does not excite any of the higher order modes of resonance of the actuator 40 in the first place as there are no harmonic frequencies contained within a sine wave. However, piezoelectric drive circuits typically employ square-wave drive signals for actuators because the drive circuit electronics are lower cost and more compact which is important for medical and other applications of the pump 10 described in this application. Therefore, a preferred strategy is to modify the PWM square-wave signal 370 for the actuator 40 so as to avoid driving the actuator 40 at the frequency of its third mode 313 at 147 kHz by attenuating the seventh harmonic 377 of the drive signal. In this manner the third mode 313 or breathing mode no longer draws significant energy from the drive circuit, and the associated reduction in the efficiency of the pump 10 is avoided.

A first embodiment of the solution is to add a electrical filter in series with the actuator 40 to eliminate or attenuate the amplitude of the seventh harmonic 377 present in the square-wave drive signal. For example, a series inductor may be used as a low-pass filter to attenuate the high-frequency harmonics in the square-wave drive signal, effectively smoothing the square-wave output of the drive circuit. Such an inductor adds an impedance Z in series with the actuator, where $|Z|=2\pi fL$. Here f is the frequency in question, and L is the inductance of the inductor. For $|Z|$ to be greater than 300Ω at a frequency f=147 kHz, the inductor should have a value greater than 320 μH. Adding such an inductor significantly thereby increases the impedance of the actuator 40 at 147 kHz. Alternative low-pass filter configurations, including both analog and digital low-pass filters, may be utilized in accordance with the principles of the present invention. Alternative to a low-pass filter, a notch filter may be used to block the signal of the seventh harmonic 377 without affecting the fundamental frequency or the other harmonic signals. The notch filter may include a parallel inductor and capacitor having values of 3.9 μH and 330 nF, respectively, to suppress the seventh harmonic 377 of the drive signal. Alternative notch filter configurations, including both analog and digital notch filters, may be utilized in accordance with the principles of the present invention.

In a second embodiment, the PWM square-wave signal 370 can be modified to reduce the amplitude of the seventh harmonic 377 by modifying the duty-cycle of the PWM square-wave signal 370. A Fourier analysis of the PWM square-wave signal 370 can be used to determine a duty-cycle that results in reduction or elimination of the amplitude of the seventh harmonic of the drive frequency as indicated by Equation 1.

$$A_n = \frac{2}{T}\int_0^T \mathrm{Sin}\left(2n\pi \cdot \frac{t}{T}\right) f(t)\,dt \qquad \text{[Equation 1]}$$

Here $A_n$ is the amplitude of the $n^{th}$ harmonic, t is time, and T is the period of the square wave. The function $f(t)$ represents the PWM square wave signal 370, taking a value of −1 for the "negative" part of the square wave, and +1 for the "positive" part. The function $f(t)$ clearly changes as the duty cycle is varied.

Solving Equation 1 for the optimal duty-cycle to eliminate the seventh harmonic (i.e. setting $A_n=0$ for n=7):

$$A_7 = \frac{2}{T}\int_0^T \mathrm{Sin}\left(14\pi\cdot\frac{t}{T}\right)dt - \frac{2}{T}\int_{T_1}^T \mathrm{Sin}\left(14\pi\cdot\frac{t}{T}\right)dt = 0 \qquad \text{[Equation 2]}$$

$$\therefore\ \mathrm{Cos}\left(7\pi\frac{T_1}{T}\right) = 1$$

In these equations $T_1$ is the time at which the square wave changes sign from positive to negative, i.e. $T_1/T$ represents the duty cycle. There are an infinite number of solutions to this equation, but as we wish to maintain the square wave close to 50% duty cycle in order to preserve the fundamental component, we select a solution closest to the condition that $T_1/T$ is ½, i.e.:

$$\frac{T_1}{T} = \frac{3}{7}$$

which corresponds to a duty cycle of 42.9%. Thus, the seventh harmonic signal will be eliminated or significantly attenuated in the drive signal of the duty cycle of the PWM square-wave signal 370 is adjusted to a specific value of about 42.9%.

Referring again to FIG. 3B, a bar graph of the Fourier components (n) representing the harmonics of the PWM square-wave signal 380 indicated by the legend also are shown and listed with reference numbers TABLE I. The PWM square-wave signal 380 has a duty cycle of about 43% which alters the relative amplitudes of the harmonic components (n) compared to those of the PWM square-wave signal 370 with a 50% duty cycle without much change in the amplitude of the fundamental frequency 381. Although the amplitude of the seventh harmonic component 387 has been reduced to a negligible level as desired, the amplitude of the fourth harmonic component 384 increases from zero as a result of the duty cycle change and its frequency is close to that of the second mode 312 of the actuator 40 at 83 kHz. However, the impedance of the actuator 40 at the second mode-312 is sufficiently high (unlike the impedance at the fourth mode 314) so that insignificant energy is transferred into this actuator mode, and the presence of the fourth harmonic does not therefore significantly affect the power consumption of the actuator 40 and, consequently, the efficiency of the pump 10. With the exception of the seventh harmonic component 387, the other harmonic components shown in FIG. 3B are not problematic because they do not coincide with, or are close to, any of the bending or breathing modes of the actuator 40 shown in FIG. 3A.

The amplitude of the seventh harmonic component 387 at a 43% duty cycle is now negligibly small, such that the impact of the low impedance of the second mode 312 of the actuator 40 is negligible. Consequently, the PWM square-wave signal 380 with a 43% duty cycle does not significantly excite the second mode 312 of the actuator 40, i.e., negligible energy is transmitted into this breathing mode, so that the efficiency of the pump 10 is not compromised by using a PWM square-wave signal as the input for the actuator 40.

Figure 4A:
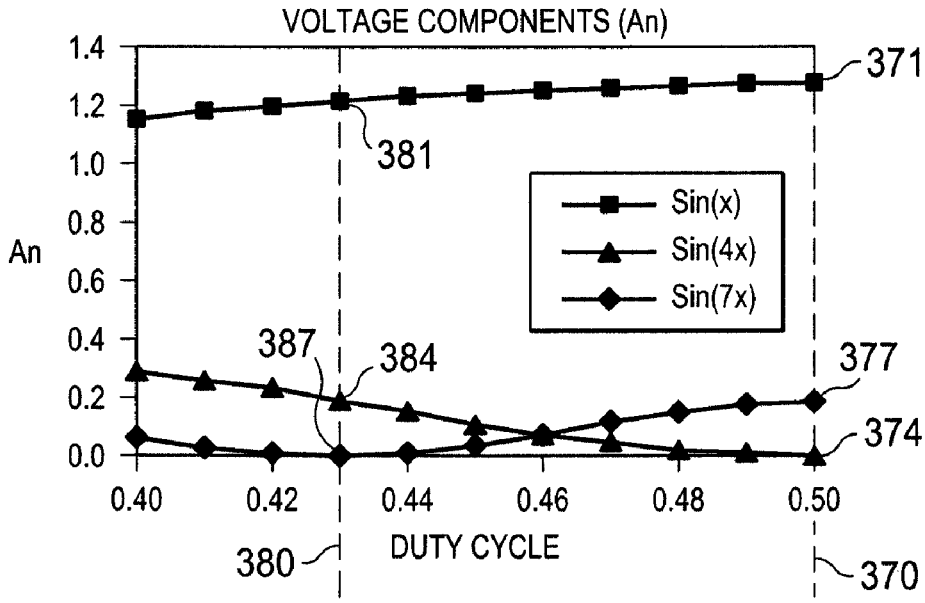
FIG. 4A shows a graph of the amplitude of certain harmonic frequency components and FIG. 4B shows a graph illustrating an example of the power dissipated by the actuator at these harmonic frequencies of the pump of FIGS. 1A-1B as a function of the duty-cycle of the square-wave signal applied to the actuator.
Figure 4B:
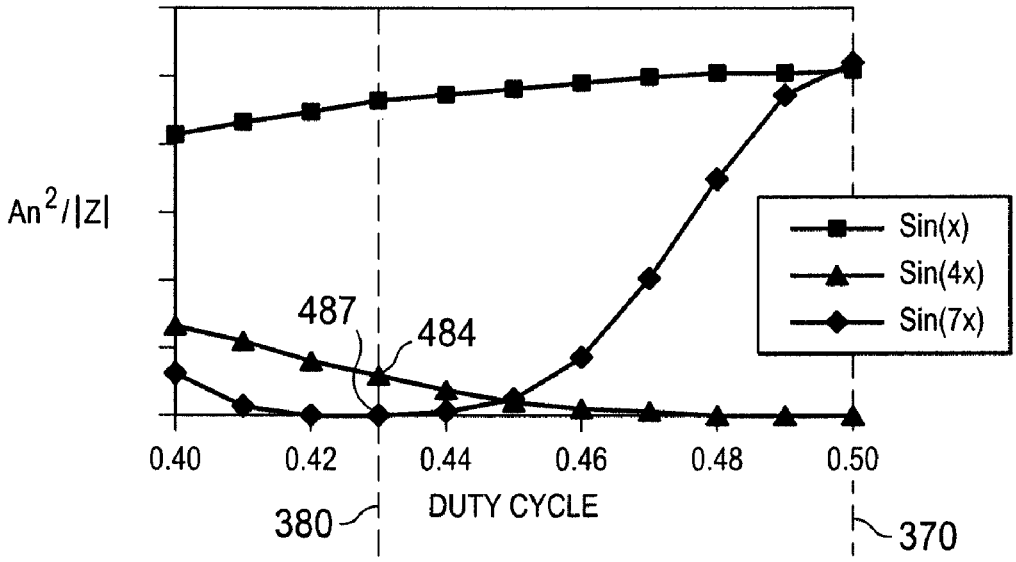

FIG. 4A shows graphs of harmonic amplitudes ($A_n$) for the fundamental frequency (labelled "sin x"), the fourth harmonic frequency ("sin 4x"), and the seventh harmonic frequency ("sin 7x") as the duty-cycle of the square-wave is varied. FIG. 4B shows the corresponding power consumption (proportional to $A_n^2/Z$, where Z is the impedance of the actuator at that frequency) of the actuator 40 as the duty-cycle of the square-wave is varied. More specifically, the fundamental frequencies 371 and 381 of the PWM square-wave signals 370 and 380, respectively, along with the corresponding amplitudes of their fourth and seventh harmonic components 374, 384 and 377, 387, respectively, described above in FIG. 3B are shown as a function of duty cycle. As can be seen in the figures, the voltage amplitude of the seventh harmonic 387 for the PWM square-wave signal 380 having a 43% duty-cycle is equal to zero, while the voltage amplitude of the fundamental component 381 decreases only slightly from its value when the duty-cycle of the PWM square-wave signal 370 is 50%. It should be noted that the fourth harmonic 374 is not present in the PWM square-wave signal 380 having a 50% duty-cycle, but is present in the PWM square-wave signal 380 having a 43% duty-cycle as described above. The increase in the voltage amplitude for the fourth harmonic 384 is not problematic, however, because the corresponding impedance of the actuator 40 at the second mode 312 of resonance is relatively higher, as described above. Consequently, applying the voltage amplitude of the fourth harmonic causes very little power dissipation 484 in the actuator 40 as shown in FIG. 4B when the duty-cycle of the square-wave is 43%. The voltage amplitude of the seventh harmonic 387 has been substantially eliminated from the PWM square-wave signal 380 having a 43% duty cycle and fundamentally negates the low impedance of the second mode 312 of the actuator 40 as indicated by the negligible power dissipation 487 in the actuator 40 as shown in FIG. 4B when the duty cycle is 43%.

Figure 5:
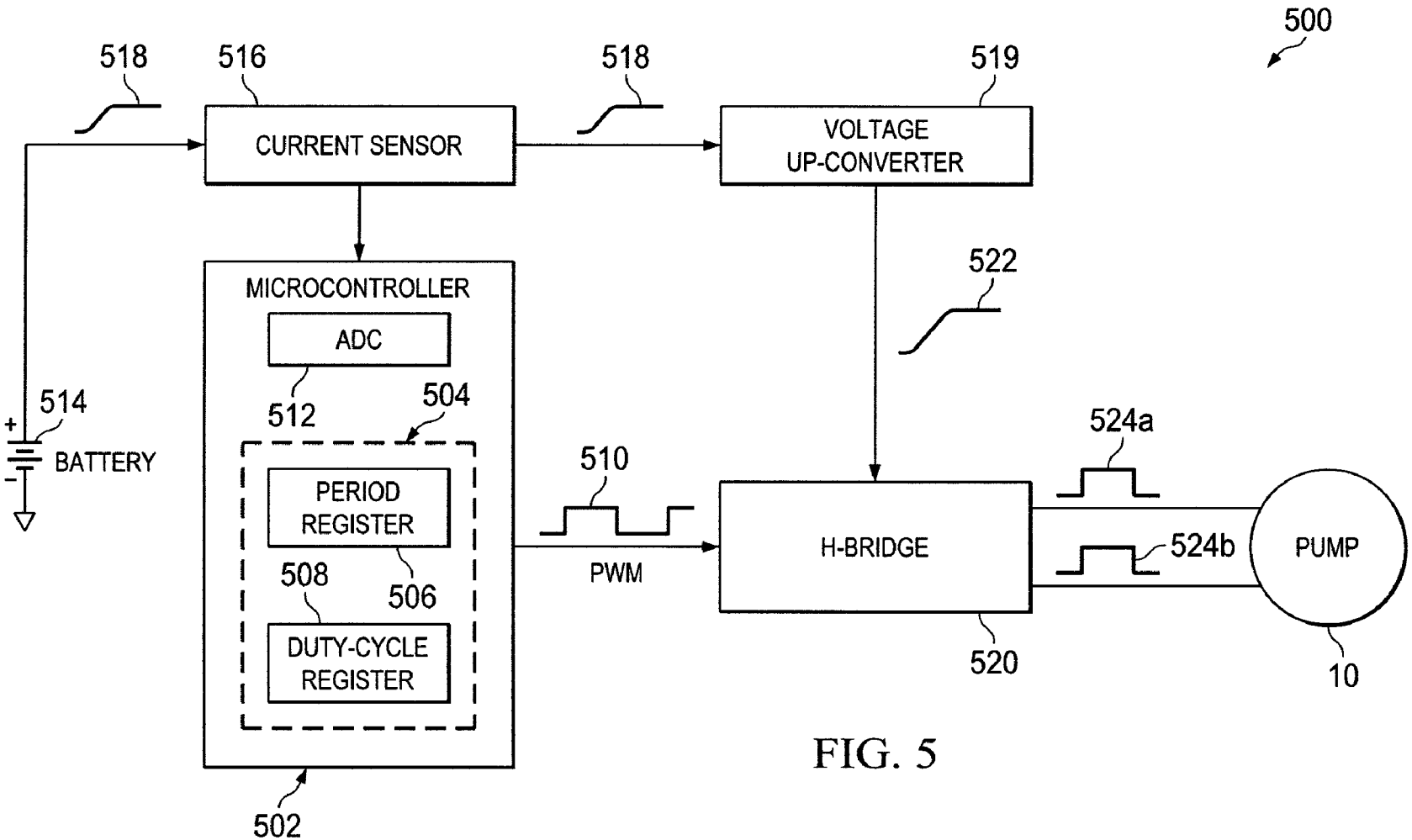
FIG. 5 shows a schematic block diagram of a drive circuit for driving the pump shown in FIGS. 1A-1B in accordance with an illustrative embodiment.

Referring now to FIG. 5, a drive circuit 500 for driving the pump 10 is shown. The drive circuit 500 may include a microcontroller 502 that is configured to generate a drive signal 510, which may be a PWM signal, as understood in the art. The microcontroller 502 may be configured with a memory 504 that stores data and/or software instructions that controls operation of the microcontroller 502. The memory 504 may include a period register 506 and a duty-cycle register 508. The period register 506 may be a memory location that stores a value that defines a period of the drive signal 510, and the duty-cycle register 508 may be a memory location that stores a value that defines a duty-cycle of the drive signal 510. In one embodiment, the values stored in the period register 506 and duty-cycle register are determined prior to execution of software by the microcontroller 502 and stored in the registers 506 and 508 by a user. The software (not shown) being executed by the microcontroller 502 may access the values stored in the registers 506 and 508 for use in establishing a period and duty-cycle for the drive signal 510. The microcontroller 502 may further include an analog-to-digital controller (ADC) 512 that is configured to convert analog signals into digital signals for use by the microcontroller 502 in generating, modifying, or otherwise controlling the drive signal 510.

The drive circuit 500 may further include a battery 514 that powers electronic components in the drive circuit 500 with a voltage signal 518. A current sensor 516 may be configured to sense current being drawn by the pump 10. A voltage up-converter 519 may be configured to up-convert, amplify, or otherwise increase the voltage signal 518 to up-converted voltage signal 522. An H-bridge 520 may be in communication with the voltage up-converter 519 and microcontroller 502, and be configured to drive the pump 10 with pump drive signals 524*a* and 524*b* (collectively 524) that are applied to the actuator of the pump 10. The H-bridge 520 may be a standard H-bridge, as understood in the art. In operation, if the current sensor 516 senses that the pump 10 is drawing too much current, as determined by the microcontroller 502 via the ADC 512, the microcontroller 502 may turn off the drive signal 510, thereby preventing the pump 10 or the drive circuit 500 from overheating or becoming damaged. Such ability may be beneficial in medical applications for example, to avoid potentially injuring a patient or otherwise being ineffective in treating the patient. The microcontroller 502 may also generate an alarm signal that generates an audible tone or visible light indicator.

The drive circuit 500 is shown as discrete electronic components. It should be understood that the drive circuit 500 may be configured as an ASIC or any other integrated circuit. It should also be understood that the drive circuit 500 may be configured as an analog circuit and use an analog sinusoidal drive signal, thereby avoiding the problem with harmonic signals.

Figure 6A:
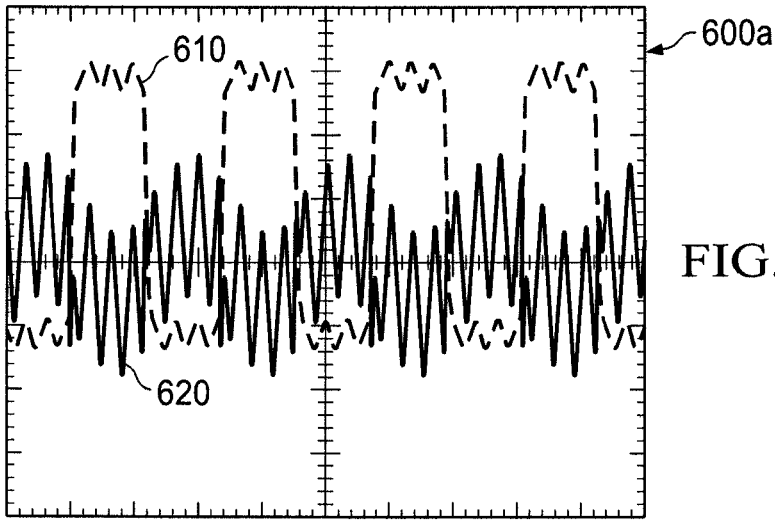
FIGS. 6A-6C are graphs showing the voltage across and current through the actuator of the pump shown in FIGS. 1A-1B for square-wave drive signals having 50%, 45%, and 43% duty-cycles, respectively.
Figure 6B:
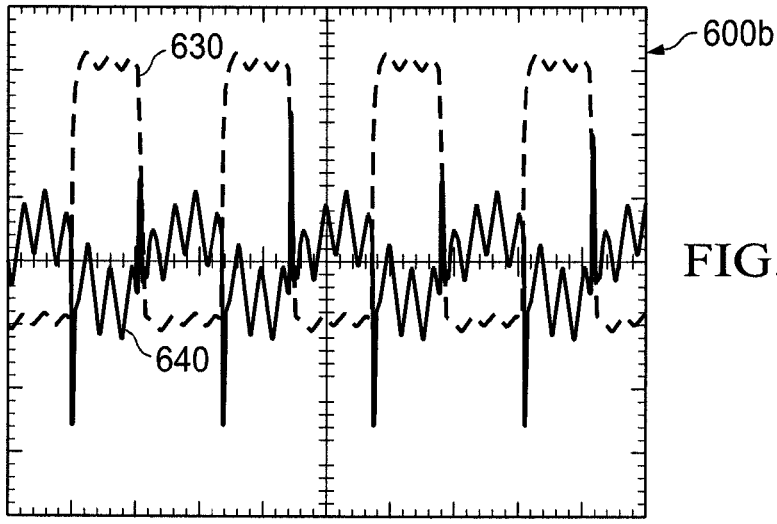
Figure 6C:
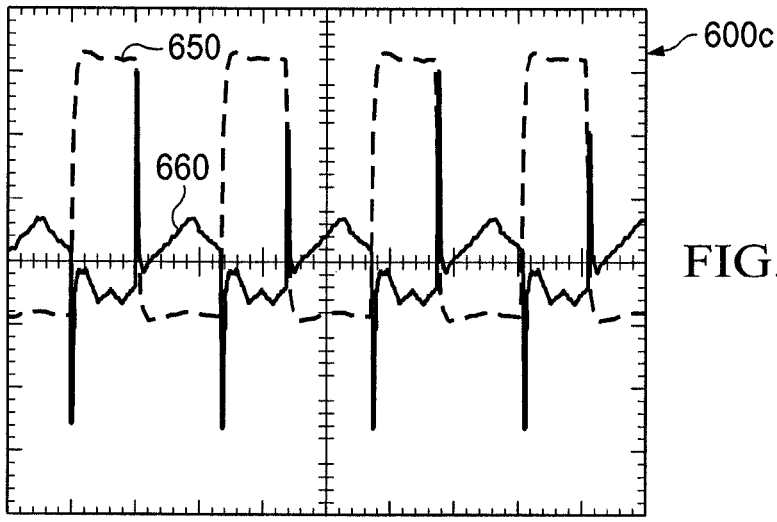

Referring now to FIGS. 6A-C, graphs 600*a-c* of square-wave drive signals 610, 630 and 650 and corresponding actuator response signals, 620, 640 and 660 are shown for a 50%, 45% and 43% duty cycle, respectively, with a fundamental frequency of about 21 kHz. The square-wave drive signals 610 and 630 with duty cycles of 50% and 45%, respectively, contain sufficient components of the seventh harmonic to excite the third mode 313 of the actuator 40 as evidenced by the high frequency components in corresponding actuator response signals 620 and 640, respectively. Such signals are evidence of significant power being delivered into the third mode 313 of the actuator 40 at around 147 kHz. However, when the duty cycle of the square-wave drive signal is set to about 43% for the square-wave drive signal 650 shown in FIG. 6C, the content of the seventh harmonic is effectively suppressed so that the energy transfer into the third mode 313 of the actuator 40 is significantly reduced as evidenced by the absence of high frequency components in the corresponding actuator response signal 660 as compared to the actuator response signals 620 and 640. In this manner, the efficiency of the pump is effectively maintained.

The impedance and corresponding modes of resonance for the actuator 40 are based on an actuator having a diameter of about 22 mm where the piezoelectric disc 20 has a thickness of about 0.45 mm and the end plate 17 has a thickness of about 0.9 mm. It should be understood that if the actuator 40 has different dimensions and construction characteristics within the scope of this application, the principles of the present invention may still be utilized by adjusting the duty cycle of the square-wave signal based on the fundamental frequency so that the fundamental breathing mode of the actuator is not excited by any of the harmonic components of the square-wave signal. More broadly, the principles of the present invention may be utilized to attenuate or eliminate the effects of harmonic components in the square-wave signal on the modes of resonance characterizing the structure of the actuator 40 and the performance of the pump 10. The principles are applicable regardless of the fundamental frequency of the square-wave signal selected for driving the actuator 40 and the corresponding harmonics.

Figure 7A:
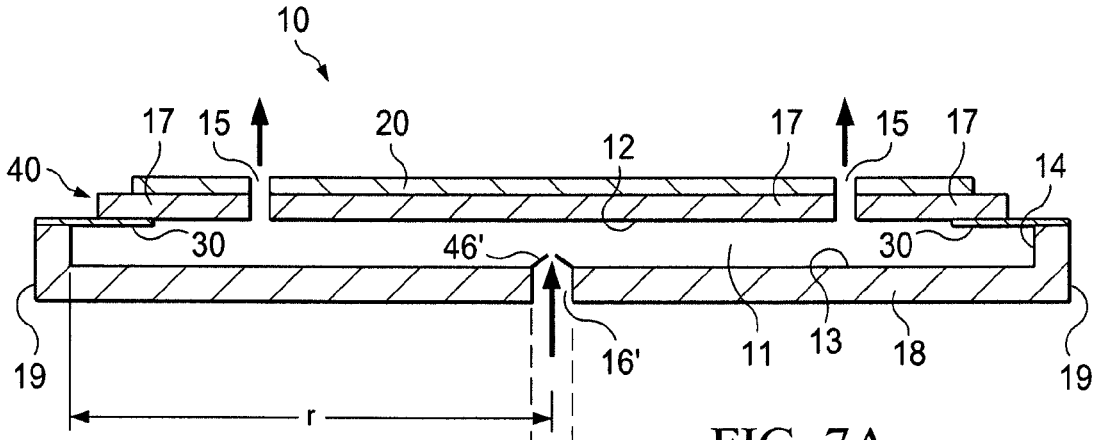
FIG. 7A shows a schematic cross-section view of a second pump according to an illustrative embodiment of the invention wherein the valve is reversed such that the pressure differential provided by the pump is opposite to that of the embodiment of FIG. 1A.

Referring to FIG. 7A, the pump 10 of FIG. 1 is shown with an alternative configuration of the primary aperture 16'. More specifically, the valve 46' in the primary aperture 16' is reversed so that the fluid is drawn into the cavity 11 through the primary aperture 16' and expelled out of the cavity 11 through the secondary apertures 15 as indicated by the arrows, thereby providing suction or a source of reduced pressure at the primary aperture 16'. The term "reduced pressure" as used herein generally refers to a pressure less than the ambient pressure where the pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

Figure 8:
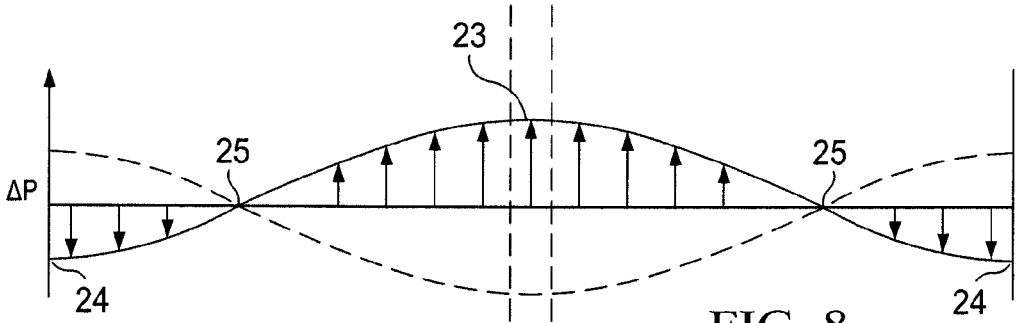
FIG. 8 shows a graph of pressure oscillations of fluid within the cavity of the second pump of FIG. 7A as shown in FIG. 2B.
Figure 7B:
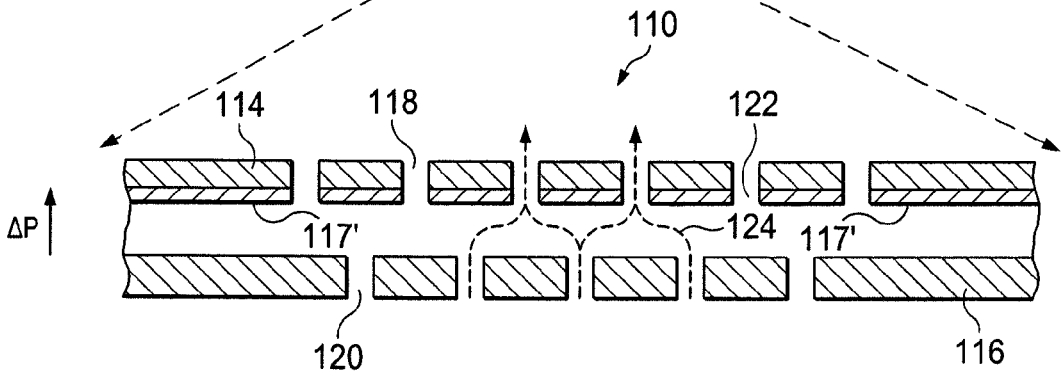
FIG. 7B shows a schematic cross-sectional view of an illustrative embodiment of a valve utilized in the pump of FIG. 7A.

FIG. 7B shows a schematic cross-section view of the pump of FIG. 7A, and FIG. 8 shows a graph of the pressure oscillations of fluid within the pump as shown in FIG. 1B. The valve 46' (as well as the valve 46) allows fluid to flow in only one direction as described above. The valve 46' may be a check valve or any other valve that allows fluid to flow in only one direction. Some valve types may regulate fluid flow by switching between an open and closed position. For such valves to operate at the high frequencies generated by the actuator 40, the valves 46 and 46' must have an extremely fast response time such that they are able to open and close on a timescale significantly shorter than the timescale of the pressure variation. One embodiment of the valves 46 and 46' achieve this by employing an extremely light flap valve which has low inertia and consequently is able to move rapidly in response to changes in relative pressure across the valve structure.

Referring to FIGS. 9A-D, such as a flap valve, valve 110 is shown according to an illustrative embodiment. The valve 110 comprises a substantially cylindrical wall 112 that is ring-shaped and closed at one end by a retention plate 114 and at the other end by a sealing plate 116. The inside surface of the wall 112, the retention plate 114, and the sealing plate 116 form a cavity 115 within the valve 110. The valve 110 further comprises a substantially circular flap 117 disposed between the retention plate 114 and the sealing plate 116, but adjacent the sealing plate 116. The flap 117 may be disposed adjacent the retention plate 114 in an alternative embodiment as will be described in more detail below, and in this sense the flap 117 is considered to be "biased" against either one of the sealing plate 116 or the retention plate 114. The peripheral portion of the flap 117 is sandwiched between the sealing plate 116 and the wall 112 so that the motion of the flap 117 is restrained in the plane substantially perpendicular the surface of the flap 117. The motion of the flap 117 in such plane may also be restrained by the peripheral portion of the flap 117 being attached directly to either the sealing plate 116 or the wall 112, or by the flap 117 being a close fit within the wall 112, in an alternative embodiment. The remainder of the flap 117 is sufficiently flexible and movable in a direction substantially perpendicular to the surface of the flap 117, so that a force applied to either surface of the flap 117 will motivate the flap 117 between the sealing plate 116 and the retention plate 114.

The retention plate 114 and the sealing plate 116 both have holes 118 and 120, respectively, which extend through each plate. The flap 117 also has holes 122 that are generally aligned with the holes 118 of the retention plate 114 to provide a passage through which fluid may flow as indicated by the dashed arrows 124 in FIGS. 7B and 10A. The holes 122 in the flap 117 may also be partially aligned, i.e., having only a partial overlap, with the holes 118 in the retention plate 114. Although the holes 118, 120, 122 are shown to be of substantially uniform size and shape, they may be of different diameters or even different shapes without limiting the scope of the invention. In one embodiment of the invention, the holes 118 and 120 form an alternating pattern across the surface of the plates as shown by the solid and dashed circles, respectively, in FIG. 9D. In other embodiments, the holes 118, 120, 122 may be arranged in different patterns without effecting the operation of the valve 110 with respect to the functioning of the individual pairings of holes 118, 120, 122 as illustrated by individual sets of the dashed arrows 124. The pattern of holes 118, 120, 122 may be designed to increase or decrease the number of holes to control the total flow of fluid through the valve 110 as required. For example, the number of holes 118, 120, 122 may be increased to reduce the flow resistance of the valve 110 to increase the total flow rate of the valve 110.

Figure 9A:
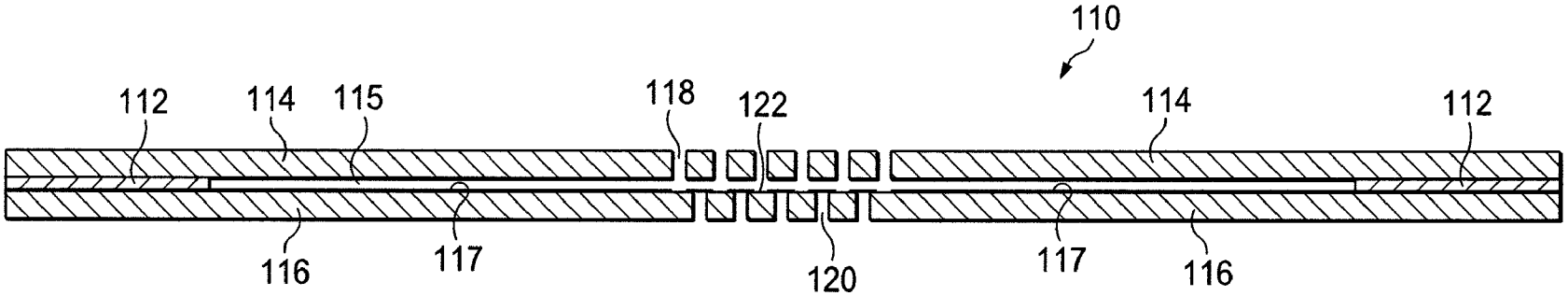
FIG. 9A shows a schematic cross-section view of an illustrative embodiment of a valve in a closed position.
Figure 9B:
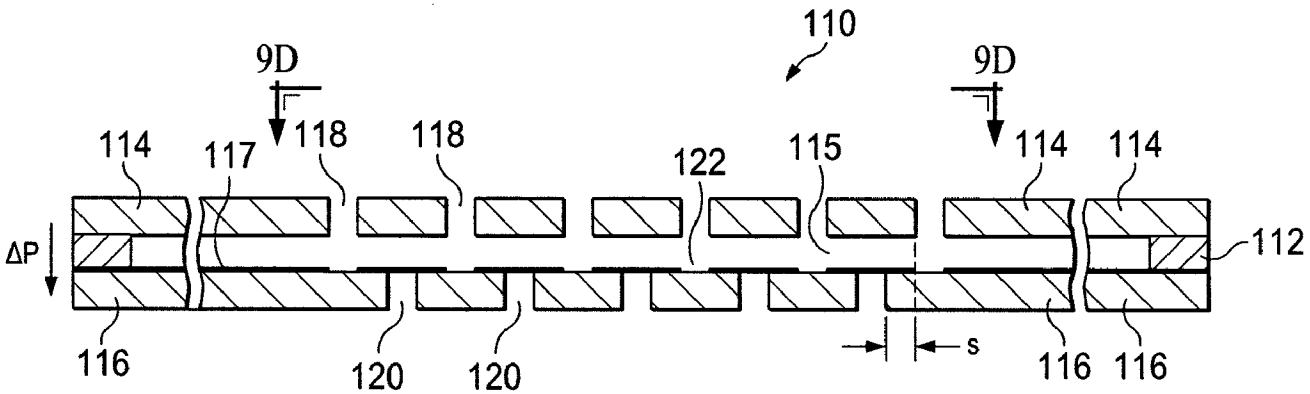
FIG. 9B shows an exploded, sectional view of the valve of FIG. 9A taken along line 9B-9B in FIG. 9D.
Figure 9C:
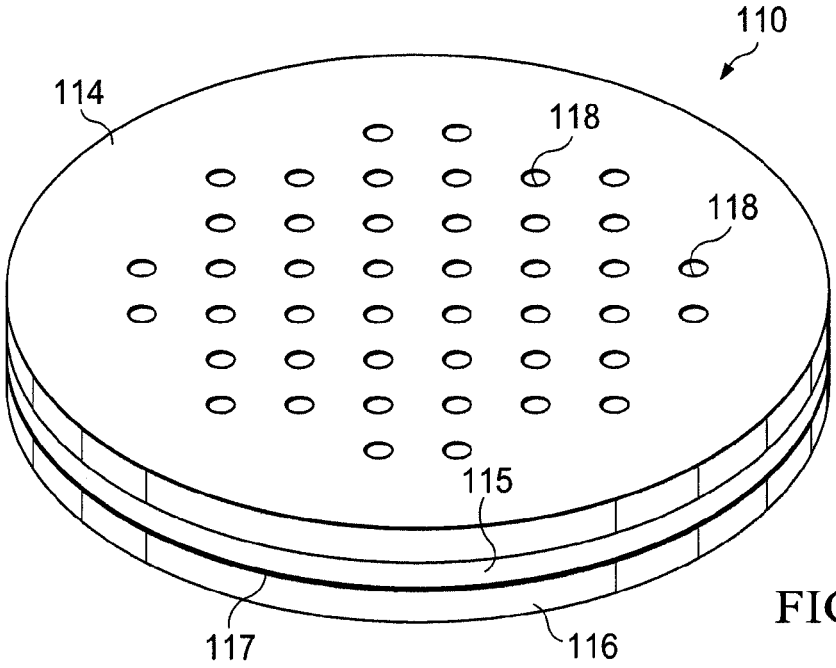
FIG. 9C shows a schematic perspective view of the valve of FIG. 9B.
Figure 9D:
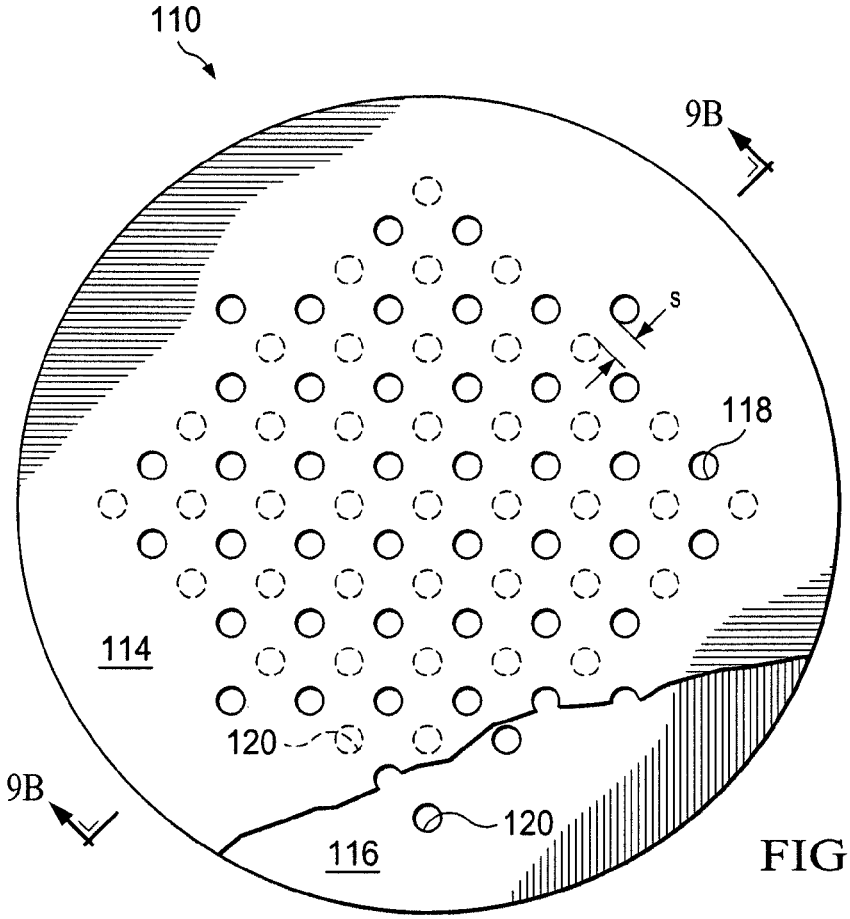
FIG. 9D shows a schematic top view of the valve of FIG. 9B.
Figure 10A:
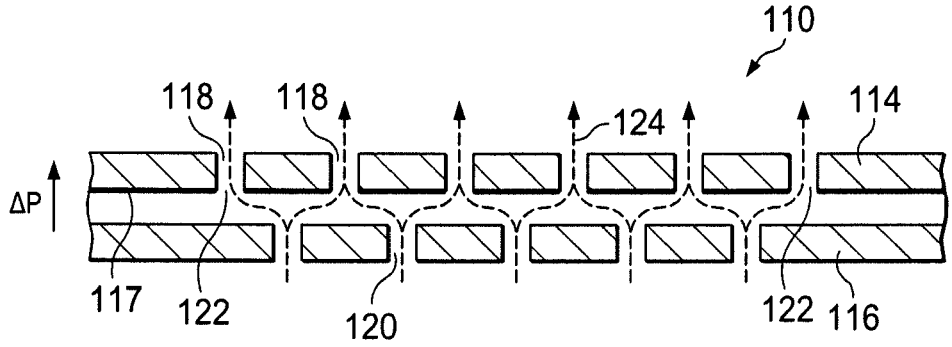
FIG. 10A shows a schematic cross-section view of the valve in FIG. 9B in an open position when fluid flows through the valve.
Figure 10B:
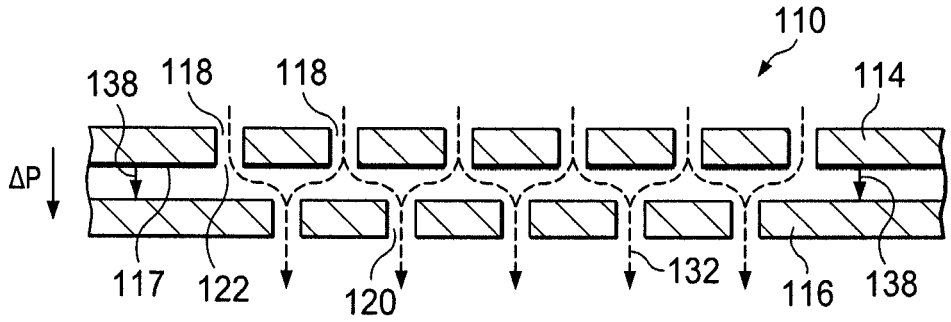
FIG. 10B shows a schematic cross-section view of the valve in FIG. 9B in transition between the open and closed positions before closing.
Figure 10C:
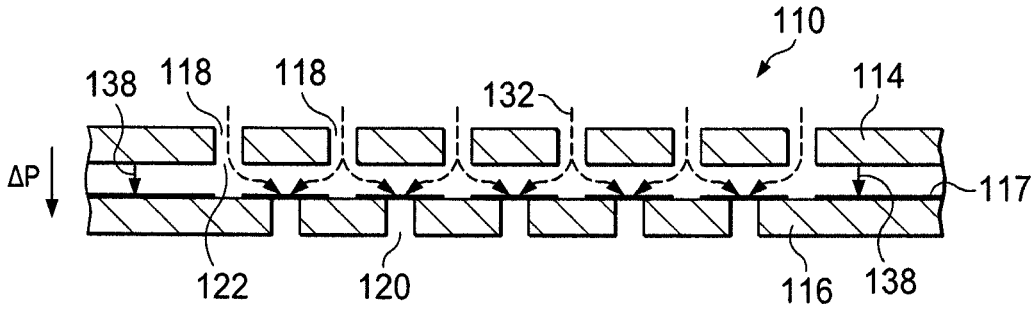
FIG. 10C shows a schematic cross-section view of the valve of FIG. 9B in a closed position when fluid flow is blocked by the valve.

When no force is applied to either surface of the flap 117 to overcome the bias of the flap 117, the valve 110 is in a "normally closed" position because the flap 117 is disposed adjacent the sealing plate 116 where the holes 122 of the flap are offset or not aligned with the holes 118 of the sealing plate 116. In this "normally closed" position, the flow of fluid through the sealing plate 116 is substantially blocked or covered by the non-perforated portions of the flap 117 as shown in FIGS. 9A and 9B. When pressure is applied against either side of the flap 117 that overcomes the bias of the flap 117 and motivates the flap 117 away from the sealing plate 116 towards the retention plate 114 as shown in FIGS. 7B and 10A, the valve 110 moves from the normally closed position to an "open" position over a time period, an opening time delay ($T_o$), allowing fluid to flow in the direction indicated by the dashed arrows 124. When the pressure changes direction as shown in FIG. 10B, the flap 117 will be motivated back towards the sealing plate 116 to the normally closed position. When this happens, fluid will flow for a short time period, a closing time delay ($T_c$), in the opposite direction as indicated by the dashed arrows 132 until the flap 117 seals the holes 120 of the sealing plate 116 to substantially block fluid flow through the sealing plate 116 as shown in FIGS. 9B and 10C. In other embodiments of the invention, the flap 117 may be biased against the retention plate 114 with the holes 118, 122 aligned in a "normally open" position. In this embodiment, applying positive pressure against the flap 117 will be necessary to motivate the flap 117 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

The operation of the valve 110 is a function of the change in direction of the differential pressure (ΔP) of the fluid across the valve 110. In FIG. 10B, the differential pressure has been assigned a negative value (−ΔP) as indicated by the downward pointing arrow. When the differential pressure has a negative value (−ΔP), the fluid pressure at the outside surface of the retention plate 114 is greater than the fluid pressure at the outside surface of the sealing plate 116. This negative differential pressure (−ΔP) drives the flap 117 into the fully closed position as described above wherein the flap 117 is pressed against the sealing plate 116 to block the holes 120 in the sealing plate 116, thereby substantially preventing the flow of fluid through the valve 110. When the differential pressure across the valve 110 reverses to become a positive differential pressure (+ΔP) as indicated by the upward pointing arrow in FIG. 10A, the flap 117 is motivated away from the sealing plate 116 and towards the retention plate 114 into the open position. When the differential pressure has a positive value (+ΔP), the fluid pressure at the outside surface of the sealing plate 116 is greater than the fluid pressure at the outside surface of the retention plate 114. In the open position, the movement of the flap 117 unblocks the holes 120 of the sealing plate 116 so that fluid is able to flow through them and the holes 122 and 118 of the flap 117 and the retention plate 114, respectively, as indicated by the dashed arrows 124.

When the differential pressure across the valve 110 changes back to a negative differential pressure (−ΔP) as indicated by the downward pointing arrow in FIG. 10B, fluid begins flowing in the opposite direction through the valve 110 as indicated by the dashed arrows 132, which forces the flap 117 back toward the closed position shown in FIG. 10C. In FIG. 10B, the fluid pressure between the flap 117 and the sealing plate 116 is lower than the fluid pressure between the flap 117 and the retention plate 114. Thus, the flap 117 experiences a net force, represented by arrows 138, which accelerates the flap 117 toward the sealing plate 116 to close the valve 110. In this manner, the changing differential pressure cycles the valve 110 between closed and open positions based on the direction (i.e., positive or negative) of the differential pressure across the valve 110. It should be understood that the flap 117 could be biased against the retention plate 114 in an open position when no differential pressure is applied across the valve 110, i.e., the valve 110 would then be in a "normally open" position.

Referring again to FIG. 7A-7B, the valve 110 is disposed within the primary aperture 16' of the pump 10 so that fluid is drawn into the cavity 11 through the primary aperture 16' and expelled from the cavity 11 through the secondary apertures 15 as indicated by the solid arrows, thereby providing a source of reduced pressure at the primary aperture 16' of the pump 10. The fluid flow through the primary aperture 16' as indicated by the solid arrow pointing upwards corresponds to the fluid flow through the holes 118, 120 of the valve 110 as indicated by the dashed arrows 124 that also point upwards. As indicated above, the operation of the valve 110 is a function of the change in direction of the differential pressure (ΔP) of the fluid across the entire surface of the retention plate 114 of the valve 110 for this embodiment of a negative pressure pump. The differential pressure (ΔP) is assumed to be substantially uniform across the entire surface of the retention plate 114 because the diameter of the retention plate 114 is small relative to the wavelength of the pressure oscillations in the cavity 115 and furthermore because the valve 110 is located in the primary aperture 16' near the centre of the cavity 115 where the amplitude of the central pressure anti-node is relatively constant. When the differential pressure across the valve 110 reverses to become a positive differential pressure (+ΔP) as shown in FIGS. 7B and 10A, the flap 117' is motivated away from the sealing plate 116 against the retention plate 114 into the open position. In this position, the movement of the flap 117' unblocks the holes 120 of the sealing plate 116 so that fluid is permitted to flow through them and the holes 118 of the retention plate 114 and the holes 122 of the flap 117' as indicated by the dashed arrows 124. When the differential pressure changes back to the negative differential pressure (−ΔP), fluid begins to flow in the opposite direction through the valve 110 (see FIG. 10B), which forces the flap 117 back toward the closed position (see FIG. 9B). Thus, as the pressure oscillations in the cavity 11 cycle the valve 110 between the normally closed and open positions, the pump 10 provides a reduced pressure every half cycle when the valve 110 is in the open position.

Figures 11A, 11B:
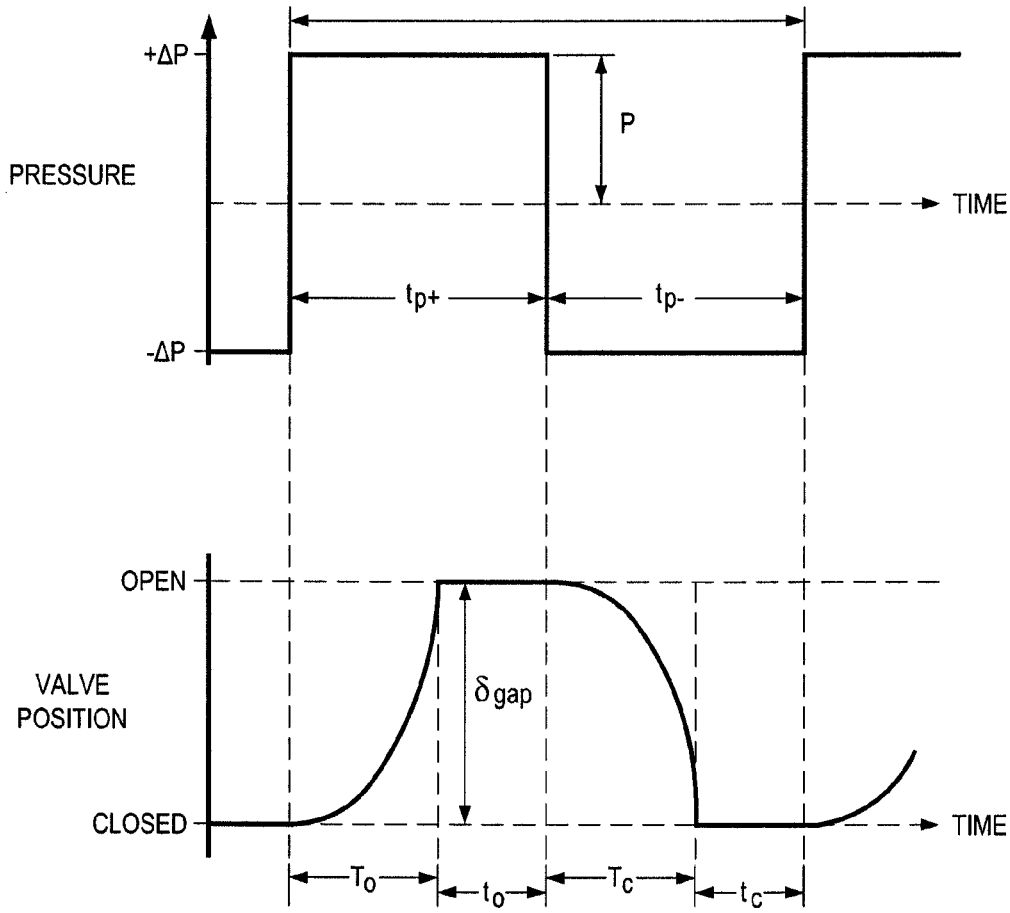
FIG. 11A shows a graph of an oscillating differential pressure applied across the valve of FIG. 9B according to an illustrative embodiment.
FIG. 11B shows a graph of an operating cycle of the valve of FIG. 9B between an open and closed position.

The differential pressure (ΔP) is assumed to be substantially uniform across the entire surface of the retention plate 114 because it corresponds to the central pressure anti-node 23 as described above, it therefore being a good approximation that there is no spatial variation in the pressure across the valve 110. While in practice the time-dependence of the pressure across the valve may be approximately sinusoidal, in the analysis that follows it shall be assumed that the differential pressure (ΔP) between the positive differential pressure (+ΔP) and negative differential pressure (−ΔP) values can be represented by a square wave over the positive pressure time period ($t_{P+}$) and the negative pressure time period ($t_{P-}$) of the square wave, respectively, as shown in FIG. 11A. As differential pressure (ΔP) cycles the valve 110 between the normally closed and open positions, the pump 10 provides a reduced pressure every half cycle when the valve 110 is in the open position subject to the opening time delay ($T_o$) and the closing time delay ($T_c$) as also described above and as shown in FIG. 11B. When the differential pressure across the valve 110 is initially negative with the valve 110 closed (see FIG. 9B) and reverses to become a positive differential pressure (+ΔP), the flap 117' is motivated away from the sealing plate 116 towards the retention plate 114 into the open position (see FIG. 10A) after the opening time delay ($T_o$). In this position, the movement of the flap 117' unblocks the holes 120 of the sealing plate 116 so that fluid is permitted to flow through them and the holes 118 of the retention plate 114 and the holes 122 of the flap 117 as indicated by the dashed arrows 124, thereby providing a source of reduced pressure outside the primary aperture 46' of the pump 10 over an open time period ($t_o$). When the differential pressure across the valve 110 changes back to the negative differential pressure (−ΔP), fluid begins to flow in the opposite direction through the valve 110 (see FIG. 10B) which forces the flap 117 back toward the closed position after the closing time delay ($T_c$) as shown in FIG. 10C. The valve 110 remains closed for the remainder of the half cycle or the closed time period ($t_c$).

The retention plate 114 and the sealing plate 116 should be strong enough to withstand the fluid pressure oscillations to which they are subjected without significant mechanical deformation. The retention plate 114 and the sealing plate 116 may be formed from any suitable rigid material, such as glass, silicon, ceramic, or metal. The holes 118, 120 in the retention plate 114 and the sealing plate 116 may be formed by any suitable process including chemical etching, laser machining, mechanical drilling, powder blasting, and stamping. In one embodiment, the retention plate 114 and the sealing plate 116 are formed from sheet steel between 100 and 200 microns thick, and the holes 118, 120 therein are formed by chemical etching. The flap 117 may be formed from any lightweight material, such as a metal or polymer film. In one embodiment, when fluid pressure oscillations of 20 kHz or greater are present on either the retention plate side or the sealing plate side of the valve 110, the flap 117 may be formed from a thin polymer sheet between 1 micron and 20 microns in thickness. For example, the flap 117 may be formed from polyethylene terephthalate (PET) or a liquid crystal polymer film approximately 3 microns in thickness.

We claim:

1. A pump comprising:

a pump body having a substantially cylindrical shaped cavity having a side wall closed by two end surfaces for containing a fluid, the cavity having a height (h) and a radius (r), wherein a ratio of the radius (r) to the height (h) is greater than about 1.2;

a piezoelectric device operatively associated with a central portion of one end surface and adapted to cause an oscillatory motion of the end surface at a frequency (f) having bending modes and breathing modes of resonance, thereby generating radial pressure oscillations of the fluid within the cavity including at least one annular pressure node in response to a drive signal being applied to the piezoelectric device;

a drive circuit having an output electrically connected to the piezoelectric device for providing the drive signal to the piezoelectric device at the frequency (f), wherein the drive signal is a square-wave signal having a duty cycle that attenuates a harmonic component of the square-wave signal coinciding with a frequency of a mode of the piezoelectric device other than the fundamental bending mode of the piezoelectric device;

a first aperture disposed at any location in the cavity other than at the location of the annular pressure node and extending through the pump body;

a second aperture disposed at any location in the pump body other than the location of the first aperture and extending through the pump body; and, a valve disposed in at least one of the first aperture and second aperture to enable the fluid to flow through the cavity when in use.

2. The pump of claim 1, wherein the frequency (f) is set at a value about equal to a fundamental bending mode of the piezoelectric device.

3. The pump of claim 1, wherein the height (h) of the cavity and the radius (r) of the cavity are further related by the following equation: $h^2/r>4\times10^{-10}$ meters.

4. The pump of claim 1, wherein the piezoelectric device has a radius (a) greater than or equal to 0.63(r).

5. The pump of claim 4, wherein the radius (a) of said the piezoelectric device is less than or equal to the radius of the cavity (r).

6. The pump of claim 1, wherein said second valve aperture is disposed in one of the end surfaces at a distance of about 0.63(r)±0.2(r) from the centre of the end surface.

7. The pump of claim 1, wherein said valve permits the fluid to flow through the cavity in substantially one direction.

8. The pump of claim 1, wherein the ratio is within the range between about 10 and about 50 when the fluid in use within the cavity is a gas.

9. The pump of claim 1, wherein the ratio of $h^2/r$ is between about $10^{-3}$ meters and about $10^{-6}$ meters when the fluid in use within the cavity is a gas.

10. The pump of claim 1, wherein the volume of the cavity is less than about 10 ml.

11. The pump of claim 1, wherein the drive circuit includes a low-pass filter for attenuating the harmonic component of the square-wave signal.

12. The pump of claim 1, wherein the drive circuit includes a notch filter for attenuating the harmonic component of the square-wave signal.

13. The pump of claim 1, wherein the duty cycle is equal to a value wherein the harmonic component of the square-wave signal coinciding with the frequency of a mode of the piezoelectric device is set to zero.

14. The pump of claim 13, wherein the duty cycle is about 42.9% to attenuate the seventh harmonic component of the square-wave signal coinciding with the frequency of a fundamental breathing mode of the piezoelectric device.

* * * * *